US005933967A

United States Patent [19]

Fazzini

[11] Patent Number: 5,933,967

[45] Date of Patent: Aug. 10, 1999

[54] KNIFE PROVIDED WITH CUT-WIDTH ADJUSTING AND GUIDING MEANS

[76] Inventor: Patrizio Fazzini, Via Roma, 54, 22050 Premana, Italy

[21] Appl. No.: 08/943,290

[22] Filed: Oct. 14, 1997

[30] Foreign Application Priority Data

Sep. 8, 1997 [IT] Italy ..... MI97A2040

[51] Int. Cl.[6] ..... B26B 3/03

[52] U.S. Cl. ..... 30/283; 30/293

[58] Field of Search ..... 30/283, 292, 278, 30/286, 293, 294

[56] References Cited

U.S. PATENT DOCUMENTS

| | | | |
|---|---|---|---|
| 605,944 | 6/1898 | Wright | 30/283 |
| 2,453,220 | 11/1948 | Gustafson | 30/293 |
| 3,091,854 | 6/1963 | Mannerberg | 30/283 |
| 3,178,817 | 4/1965 | Rubinstein | 30/283 |
| 3,271,855 | 9/1966 | Stolbach | 30/283 |
| 5,575,070 | 11/1996 | Anderson | 30/283 |

FOREIGN PATENT DOCUMENTS

| | | | |
|---|---|---|---|
| 262753 | 10/1949 | Germany | 30/283 |

*Primary Examiner*—Rinaldi I. Rada
*Assistant Examiner*—Gyounghyun Bae
*Attorney, Agent, or Firm*—Bucknam and Archer

[57] ABSTRACT

A knife construction comprises a cutting blade coupled to a handle and a U-shaped guiding element rotatably coupled to the cutting blade and driven by a rotary pawl for adjusting the cut-width of the cutting blade, the knife further comprising a hollow block, constituting a part of the rotary connection of the guiding element to the cutting blade, for driving the guiding element with respect to the cutting blade, to cause the guiding element to abut on a cutting surface.

2 Claims, 2 Drawing Sheets

KNIFE PROVIDED WITH CUT-WIDTH ADJUSTING AND GUIDING MEANS

BACKGROUND OF THE INVENTION

The present invention relates to a knife provided with cut-width adjusting and guiding means.

Knives provided with a guiding plate or bar spaced from the knife blade so as to provide a substantially constant cutting width during a cutting operation, are already known.

These prior knives, however, have the drawback that they do not allow a full cutting of slices since the guiding element thereof projects from the cutting edge of the cutting blade thereof, to provide a good adjustment.

Other prior solutions in which the guiding element is arranged adjoining the cutting blade edge do not allow the cutting blade to be properly located at the start of the cutting operation.

SUMMARY OF THE INVENTION

Accordingly, the aim of the present invention is to overcome the above mentioned drawbacks, by providing a knife including means for adjusting and guiding the cutting or cut-width thereof, allowing the blade to be always accurately located with respect to the element or slice to be cut, while affording the possibility of performing a full cutting operation, i.e. up to the cutting surface.

Within the scope of the above mentioned aim, a main object of the present invention is to provide such a knife including means for adjusting the cutting width, which can be easily and quickly accessed, thereby allowing a precise adjustment to be made.

Another object of the present invention is to provide such a knife which, due to the specifically designed features thereof, is very reliable and safe in operation.

Yet another object of the present invention is to Provide such a knife including cut-width adjusting and guiding means which can be made starting from easily commercially available elements and materials and which, moreover, is very competitive from a mere economic standpoint.

According to one aspect of the present invention, the above mentioned aim and objects, as well as yet other objects, which will become more apparent hereinafter, are achieved by a knife provided with cut-width adjusting and guiding means, comprising a cutting blade coupled to a handle and a guiding element for adjusting a cut-width thereof, characterized in that said knife further comprises driving means for driving said guiding element with respect to said cutting blade, as said guiding element is pushed against a cutting surface or is raised away from said cutting surface.

BRIEF DESCRIPTION OF THE DRAWINGS

Further characteristics and advantages of the present invention will become more apparent hereinafter from the following detailed disclosure of a knife including cut-width adjusting and guiding means, which is illustrated, by way of an indicative, but not limitative example, in the figures of the accompanying drawings, where.

DESCRIPTION OF THE PREFERRED EMBODIMENTS

Figure 1:
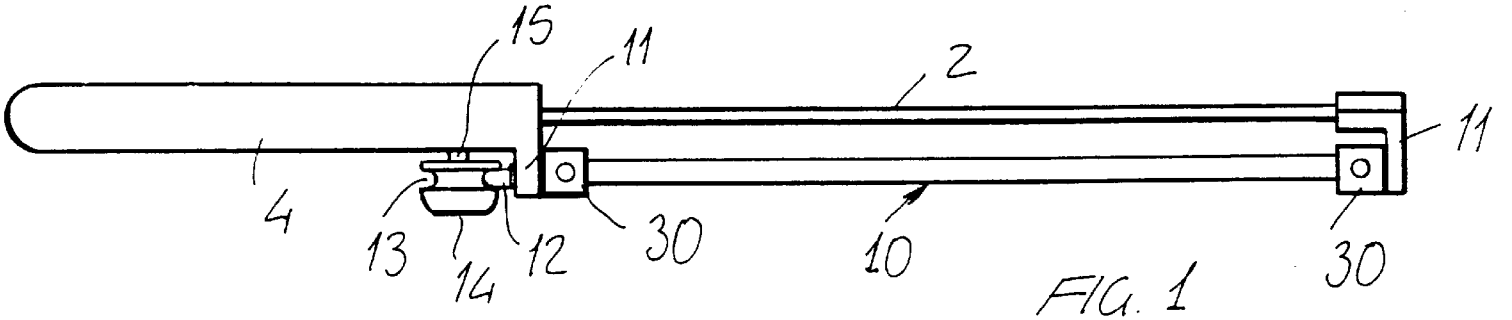
FIG. 1 is a top plan view illustrating the knife according to the present invention.
Figure 2:
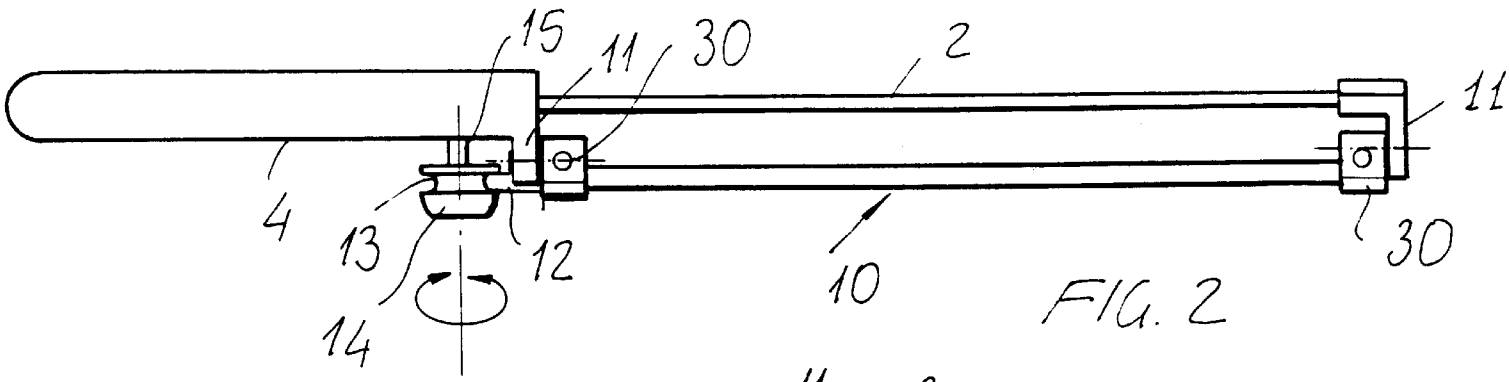
FIG. 2 illustrates that same knife construction with a different cut-width adjustment
Figure 3:
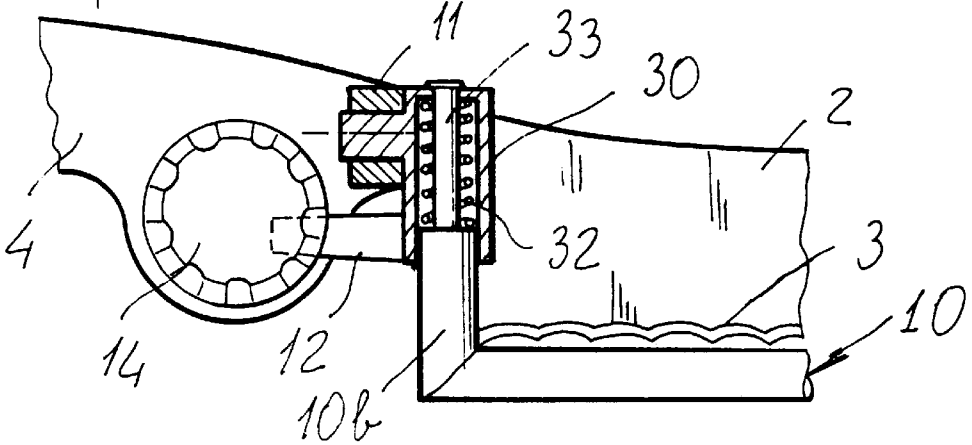
FIG. 3 is a cross-sectional view illustrating driving means for driving the guiding element of the knife.
Figure 4:
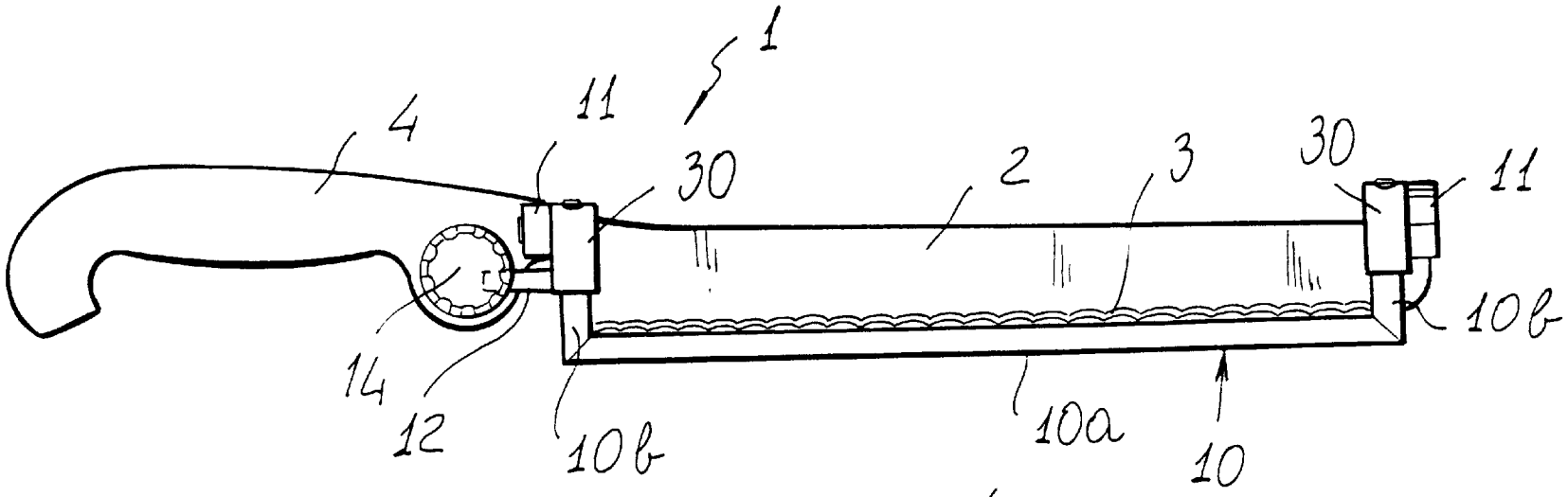
FIG. 4 is a side elevation view illustrating the subject knife.
Figure 5:
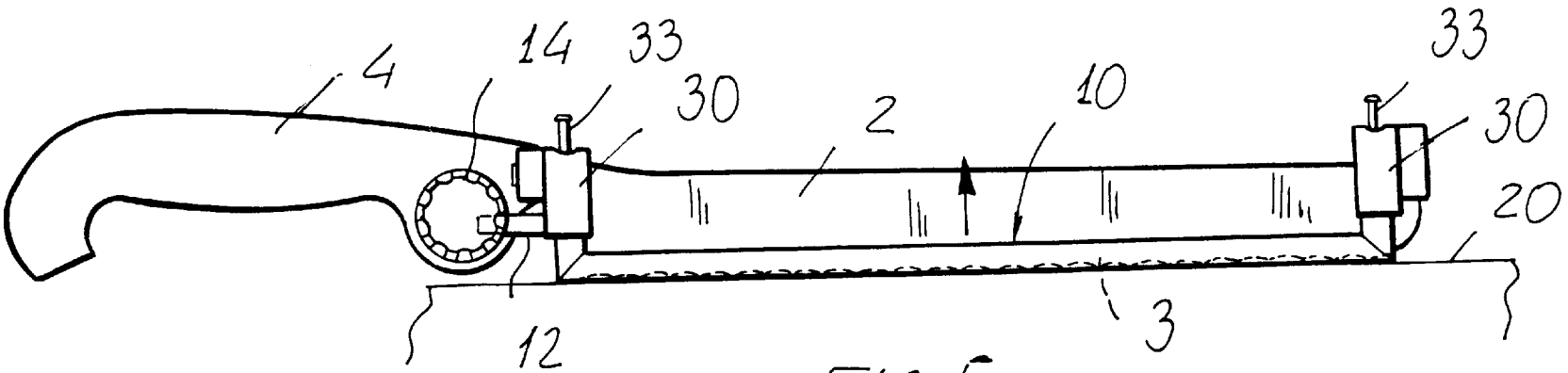
FIG. 5 illustrates a driving operation in which the guiding element is driven or displaced as said guiding element abuts against a cutting surface.

With reference e to the number references of the above mentioned figures, the knife provided with cut-width adjusting and guiding means according to the present invention, which has been generally indicated by the reference number 1, comprises a cutting blade 2, which can have any suitable configuration and which, preferably, though not necessarily, ends with a cutting edge 3, of saw tooth configuration.

The cutting blade 2 is coupled to a handle 4 which is applied, in a per se known manner, on an extension of the cutting blade.

Adjoining the cutting blade is provided a guiding element, indicated by 10, which is coupled, by pivot elements 11 allowing said guiding element to turn about a rotary axis substantially parallel to the cutting blade 2 laying plane, so that different cut-widths can be obtained by changing the spacing from the cutting blade of a U-shape element having a central portion 10*a* thereof adjoining the cutting edge 3 and arm portions 10*b* thereof pivoted to said pivot elements 11.

In order to properly locate the guiding element, is provided a lug 12 projecting from an arm 10*b* and engaging in a groove 13 of a pawl 14 coupled to a threaded pin 15 projecting from said handle 4.

Thus, by turning the pawl 14, said pawl will also be displaced linearly away from or toward the central portion 10*a* of the guiding element, with respect to the cutting edge of the cutting blade thereby changing the cutting or cut-width.

The guiding element 10*a* has the main feature that it projects from the cutting edge 3, thereby allowing the cutting edge 3 to be easily arranged on the element to be cut.

In order to cut a full slice, are provided driving means for allowing the U-shape element to be displaced with respect to the cutting blade, as the guiding element, and, more specifically, the central portion 10*a* thereof, abuts against the cutting surface 20.

Said driving means comprise a driving block 30, forming a portion of the pivot elements 11, and defining in its inside a cavity 31 in which the arm 10*b* can slide, as urged by and under the effect of an urging spring 32, arranged about a stem 33, projecting from the bottom of said cavity and being coupled to the arm 10*b*.

With the disclosed arrangement, at the end of the cutting operation, the guiding element and, more specifically, the central portion 10*a* thereof, will abut against the cutting surface so that, by overcoming the resilient urging of said spring 32, the arms 10*b* will enter again said cavity 31, thereby providing a full-cut operation.

The guiding element is outwardly arranged and, upon ending the cutting operation, by removing the knife from the cutting surface, the central portion of said guiding element will project from the cutting blade edge, thereby providing a very good adjustment of the width of the slice of the product being cut.

From the above disclosure it should be apparent that the invention fully achieves the intended aim and objects.

In particular, a knife has been provided, in which are provided driving means for driving the guiding element in a direction substantially parallel to the cutting blade direction.

Thus, the guiding element can be withdrawn, thereby providing a full-cut slice.

In practicing the invention, the used materials, provided that they are compatible to the intended application, as well as the contingent size and shapes, can be any, depending on requirements.

I claim:

1. A knife provided with cut-width adjustment, comprising:

a cutting blade coupled to a handle, said cutting blade having a laying plane in which said cutting blade extends;

a U-shaped guiding element for adjusting a cut-width of said cutting blade, said U-shaped guiding element being provided with a central portion substantially adjoining a cutting edge of said cutting blade as well as guiding element arms for coupling to said handle and said cutting blade;

pivot elements coupled with said U-shaped guiding element such as to allow a swinging movement of said U-shaped guiding element about an axis extending substantially parallel to said laying plane of said cutting blade for arranging said U-shaped guiding element in a selected lateral position with respect to said cutting blade for adjusting the cut-width of the knife, and a driving device for driving said U-shaped guiding element with respect to said cutting blade, as said U-shaped guiding element pushed against a cutting surface or is raised away from said cutting surface, said driving device comprising driving blocks coupled with said pivot elements and each provided with an inside cavity in which an end portion of a respective one of the guiding element arms of said U-shaped guiding element can slide, each said end portion being urged by an urging spring arranged about a stem projecting from each said end portion through a bottom of said inside cavity.

2. A knife according to claim 7 further comprising a lug radially projecting from one of said guiding element arms and engaging in a groove of a pawl rotatably supported by a threaded pin laterally projecting from said handle for arranging said U-shaped guiding element in a selected lateral position with respect to said cutting blade for adjusting the cut-width of the knife.

* * * * *